United States Patent [19]

Hughes

[11] 4,190,203

[45] * Feb. 26, 1980

[54] VORTEX GENERATING DEVICE WITH RESONATOR

[75] Inventor: Nathaniel Hughes, Palm Springs, Calif.

[73] Assignee: Hughes Sciences Group, Inc., Palm Springs, Calif.

[ * ] Notice: The portion of the term of this patent subsequent to Mar. 11, 1997, has been disclaimed.

[21] Appl. No.: 886,287

[22] Filed: Mar. 13, 1978

[51] Int. Cl.[2] ..... B05B 17/06; F15C 1/16

[52] U.S. Cl. ..... 239/102; 137/808; 239/405; 239/467; 261/DIG. 48; 261/DIG. 78

[58] Field of Search ..... 239/102, 403, 405, 431, 239/434, 463, 466, 467, 472, 474, 475, 487, 488, 499, 500, 518, 524, 589, 590–590.5, DIG. 20; 137/808, 811; 261/DIG. 48, DIG. 78

[56] References Cited

U.S. PATENT DOCUMENTS

| | | | |
|---|---|---|---|
| 3,064,619 | 11/1962 | Fortman | 239/102 |
| 3,169,509 | 2/1965 | Rich | 239/102 X |
| 3,226,029 | 12/1965 | Goodman et al. | 239/102 X |
| 3,747,851 | 7/1973 | Conrad | 239/102 X |
| 3,806,029 | 4/1974 | Hughes | 239/102 X |

FOREIGN PATENT DOCUMENTS

| | | | |
|---|---|---|---|
| 263446 | 9/1970 | U.S.S.R. | 239/102 |

*Primary Examiner*—John J. Love
*Assistant Examiner*—Andres Kashnikow
*Attorney, Agent, or Firm*—Christie, Parker & Hale

[57] ABSTRACT

A vortex is formed in fluid flowing through a flow passage from the inlet of the passage to its outlet. A resonator is disposed at the outlet external to the passage to intercept fluid flowing vortically through the passage. A bluff body lies between the outlet of the passage and the resonator to interrupt fluid flowing through the passage. The resonator is cylindrical having an axis aligned with the axis of the flow passage, an open end facing toward the outlet of the flow passage, and a closed end. Preferably, the bluff body is adjacent to the open end of the resonator and the length and width of the resonator are approximately multiples of the diameter of the bluff body.

90 Claims, 8 Drawing Figures

VORTEX GENERATING DEVICE WITH RESONATOR

BACKGROUND OF THE INVENTION

This invention relates to fluid vortex generation and, more particularly, to an improved vortex generating device useful as an atomizer and/or a sonic energy transducer.

In one class of sonic energy transducer, sonic waves are generated by accelerating a gas to supersonic velocity in a nozzle. To achieve supersonic flow it has been necesary in the past to establish a large pressure drop from the inlet to the outlet of the nozzle. In order to produce sufficiently high energy levels for effective atomization and other purposes, prior art sonic energy transducers have used a resonator beyond the outlet of the supersonic nozzle, as disclosed in my U.S. Pat. No. 3,230,924, which issued Jan. 25, 1966, or a sphere in the diverging section of the supersonic nozzle, as disclosed in my U.S. Pat. No. 3,806,029, which issued Apr. 23, 1974.

In my application Ser. No. 886,289, filed on even date herewith, entitled STABLE VORTEX GENERATING DEVICE, a stable efficient vortex is generated in a flow passage having a restriction connected between a fluid inlet and outlet. A bluff body is disposed in the fluid passage between the inlet and the restriction. The inlet is transverse to the axis of the flow passage, and the bluff body is mounted on a rod extending through the flow passage. In my application Ser. No. 886,288, filed on even date herewith, entitled STABLE VORTEX GENERATING DEVICE WITH EXTERNAL BLUFF BODY a bluff body is disposed at the outlet of a flow passage external to the passage to interrupt vortically flowing fluid, thereby enhancing its energization. A number of different embodiments of the bluff body are disclosed.

SUMMARY OF THE INVENTION

According to one aspect of the invention, a resonator is disposed at the outlet of a flow passage that forms a vortex in fluid flowing therethrough. The resonator lies external to the passage to intercept fluid flowing vortically through the passage. The resonator enhances the energization of the vortically flowing fluid.

According to another aspect of the invention, a bluff body is disposed at the outlet of a flow passage external to the passage to interrupt fluid flowing through the passage, and a resonator is disposed at the outlet external to the passage to intercept flowing fluid interrupted by the bluff body. The bluff body lies between the outlet and the resonator. The resonator generates intense sound waves capable of powerful atomization.

A feature of the invention is the scaling of the resonator described in the preceding paragraph according to the diameter of the bluff body. Specifically, the length and width of the resonator are approximately equal to a multiple of the diameter of the bluff body. Scaling of the resonator in this fashion maximizes the atomizing power of the device.

Preferably, the resonator is cylindrical, having an axis aligned with the flow axis of the passage, an inlet with an open end facing toward the flow passage, and a closed end.

BRIEF DESCRIPTION OF THE DRAWINGS

The features of specific embodiments of the best mode contemplated of carrying out the invention are illustrated in the drawings, in which.

DETAILED DESCRIPTION OF THE SPECIFIC EMBODIMENTS

The disclosure of my application Ser. No. 785,838, now U.S. Pat. No. 4,109,862, my application Ser. No. 886,289, filed on even date herewith, entitled STABLE VORTEX GENERATING DEVICE, and my application Ser. No. 886,288, filed on even date herewith, entitled VORTEX GENERATING DEVICE WITH EXTERNAL FLOW INTERRUPTING BODY, are incorporated fully herein by reference.

Figure 1:
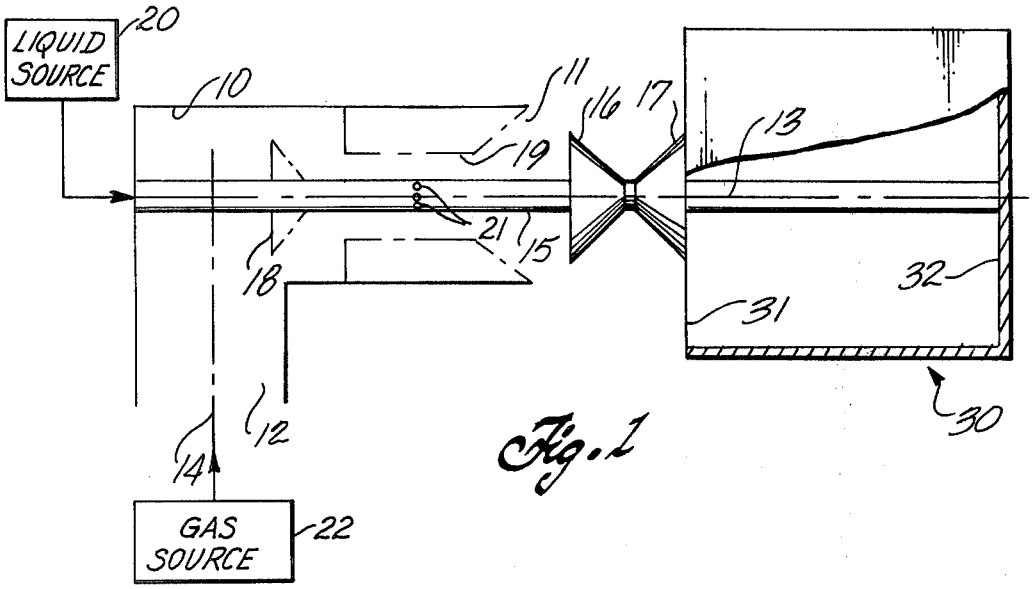
FIG. 1 is a schematic diagram of a vortex generating device with a resonator incorporating the principles of the invention.

In FIG. 1, a cylindrical flow passage 10 has an outlet 11 and a transverse cylindrical inlet 12. Passage 10 has a cylindrical axis 13 that serves as a flow axis. Inlet 12 has a cylindrical axis 14 that intersects axis 13, preferably at a right angle. A rod 15 extends all the way through passage 10 to a point well beyond outlet 11, i.e., external to passage 10, in alignment with axis 13. Conical frustums 16 and 17 are mounted in alignment with axis 13 on rod 15 external to passage 10, where they are arranged apex-to-apex to form therebetween an annunl channel. The bases of frustums 16 and 17 have flat circular surfaces. The base of frustum 16 faces toward outlet 11, and the base of frustum 17 faces away from outlet 11. Frustums 16 and 17 together comprise an external bluff body. A vortex is formed in the fluid flowing through passage 10 by a frustum 18 and a nozzle 19 in the manner described in my referenced application entitled STABLE VORTEX GENERATING DEVICE. Frustum 18 and nozzle 19 are shown in phantom to indicate that other types of elements for forming a vortex in passage 10 could be employed in practicing the invention, including the other embodiments in my referenced application entitled STABLE VORTEX GENERATING DEVICE, or internal vortex forming elements could be eliminated altogether in some embodiments. Except for substitution of frustums 16 and 17 for a sphere, the portion of FIG. 1 described to this point is the same as FIG. 1 of my referenced application entitled STABLE VORTEX GENERATING DEVICE. If desired, rod 15 could be hollow and carry a liquid under pressure from a liquid source 20 to be atomized to nozzle 19 or other desired point along axis 13 by means of liquid feed holes 21 in the manner described in the referenced application entitled STABLE VORTEX GENERATING DEVICE.

A source of gas 22 is supplied to inlet 12. The gas flows from inlet 12 through passage 10 to outlet 11, and a vortex is formed therein by frustum 18 and nozzle 19. Frustums 16 and 17 serve as a bluff body to interrupt at outlet 11 fluid flowing vortically through passage 10. Resonator 30 intercepts and resonates the gas to generate intense sound waves in the audible range. These sound waves have powerful atomizing capability. If the device is used as an atomizer, liquid is fed through rod 15 preferably to holes 21 in rod 15 at nozzle 19.

A columnar resonator is mounted on the end of rod 15 external to passage 10. Specifically, resonator 30 is cylindrical, having a cylindrical axis aligned with axis 13, an open end 31 facing toward outlet 11, and a closed end 32, which is secured to the end of rod 15. Thus frustums 16 and 17 lie in a row between outlet 11 and resonator 30. Preferably, the downstream end of the bluff body, i.e., the base of frustum 17 lies in the same plane as open end 31 of resonator 30, but a displacement of the downstream end of the bluff body from the plane of end 31 within a range of plus or minus one-half the width of the bluff body, e.g., frustum base diameter, produces satisfactory results. The length of resonator 30, i.e., the distance from open end 31 to closed end 32, and the width of resonator 30, i.e., cylindrical diameter thereof, are multiples of a common divisor and preferably equal to each other.

The resonator intercepts the gas interrupted by the bluff body and resonates it in two dimensions—the outwardly moving rotating gas is resonated by virtue of the width selection of the resonator and the forwardly moving gas, i.e., gas moving along axis 13, is resonated by virtue of the length selection of the resonator. In contrast, the well known Helmholz resonator resonates only by virtue of the length selection; the width dimension is only selected with the consideration in mind of containing and intercepting all the gas flowing toward the resonator.

Figure 3:
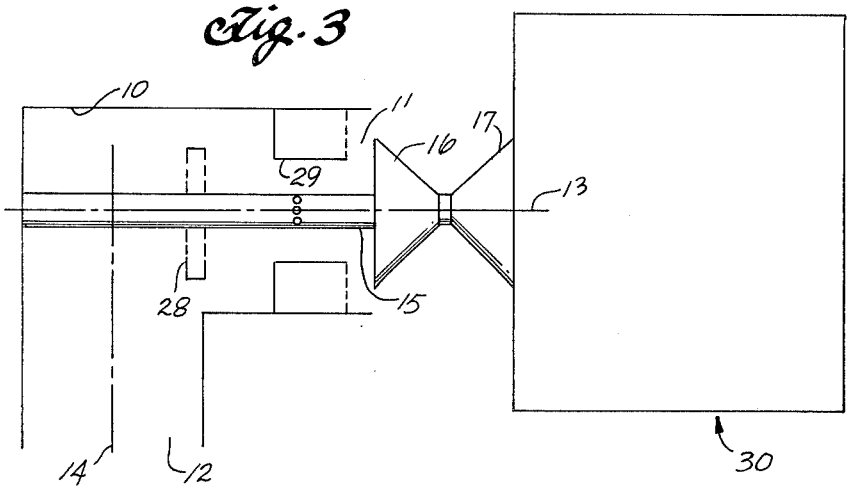
FIG. 3 is a schematic diagram of an alternative vortex generating device with a resonator incorporating the principl of the invention.

In FIG. 3, a thin flat circular disc 28 is substituted for frustum 18, and a thin flat ring 29 is substituted for nozzle 19. The thickness of disc 28 is not a significant factor, but is preferably less than one-half of its diameter. The thickness of ring 29 for supersonic flow should be at least one-half the diameter of disc 28. For most efficient operation, the distance between disc 28 and the upstream side of ring 29 is preferably approximately equal to the diameter of disc 28 or one-half the diameter of disc 28.

Instead of frustums 16 and 17, other types of bluff bodies including the bluff bodies disclosed in my referenced copending application entitled VORTEX GENERATING DEVICE WITH EXTERNAL FLOW INTERRUPTING BODY, could be interposed between outlet 11 and resonator 30. In each case, the bluff body is preferably mounted on rod 15. If a bluff body such as frustums 16 and 17 is eliminated altogether, no audible sound is generated but an enhancement of the atomizing capability of the vortically flowing gas is achieved.

Figure 4:
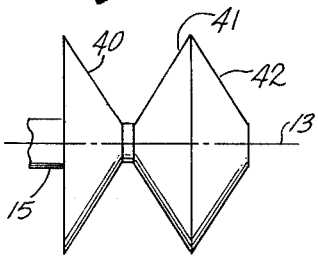
FIGS. 4 through 8 are schematic diagrams of variations of the bluff body of FIGS. 1 and 3.
Figure 5:
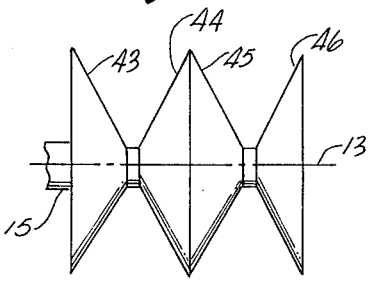
Figure 6:
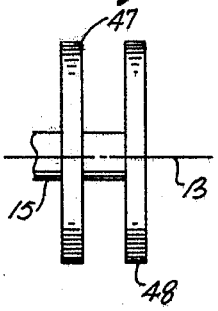
Figure 8:
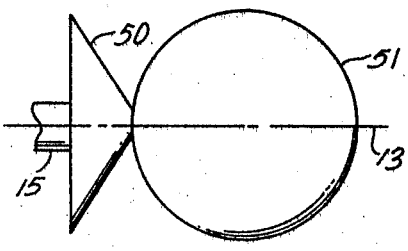
Figure 7:
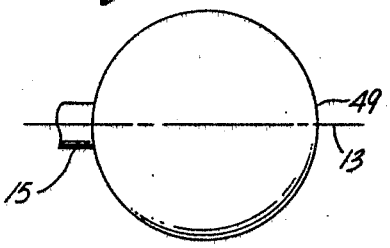

For example, in FIG. 4 the bluff body comprises frustums 40, 41, and 42. Frustums 40 and 41 are arranged apex-to-apex to form therebetween an annular channel. The base of frustum 40 faces toward outlet 11, and the base of frustum 41 faces away from outlet 11. Frustums 41 and 42 are arranged base-to-base, the base of frustum 42 abutting the base of frustum 41. In FIG. 5, the bluff body comprises frustums 43, 44, 45, and 46. Frustums 43 and 44 are arranged apex-to-apex to form therebetween an annular channel, the base of frustum 43 facing toward outlet 11 and the base of frustum 44 facing away from outlet 11. Similarly, frustums 45 and 46 are also arranged apex-to-apex to form therebetween an annular channel, and frustum 45 is arranged base-to-base with frustum 44. The distance between frustums 43 and 44 and the distance between frustums 45 and 46 are each preferably approximately equal to a multiple of one-half their diameter. The bluff body in FIG. 6 comprises flat circular discs 47 and 48 arranged side by side in alignment with axis 13 to form therebetween an annular channel. The spacing between discs 47 and 48 is approximately equal to a multiple of one-half their diameter. The thickness of discs 47 and 48 is less than one-half their diameter. In FIG. 7, the bluff body comprises a sphere 49. In FIG. 8, the bluff body comprises a frustum 50 and a sphere 51 arranged in abutting relationship to form therebetween an annular channel. The base of frustum 50 faces toward outlet 11 and its apex abuts sphere 51.

Preferably, resonator 30 is scaled to the diameter of the bluff body, e.g., the diameter of frustum 16. Specifically, the length and width of resonator 13 are approximately equal to a multiple of the diameter of the bluff body, e.g., three times the diameter of the bluff body. In a typical embodiment in which passage 10, outlet 11, inlet 12, frustums 16, 17, and 18 and nozzle 19 have the same dimensions and positions as the typical embodiment described in connection with FIG. 1 of my referenced application entitled STABLE VORTEX GENERATING DEVICE, and FIG. 1 of my referenced application entitled VORTEX GENERATING DEVICE WITH EXTERNAL FLOW INTERRUPTING BODY, the space between the base of frustum 17 and open end 31 is 0.020 inch, the internal diameter of resonator 30 is 0.600 inch, and the internal length of resonator 30 is 0.600 inch. Typically, sound levels of the order of 140 decibels have been measured at point five inches from the bluff body perpendicular to axis 13 with a gas source pressure of eight psig.

The cross-sectional area of rod 15 is preferably between about 10% to 20% of the minimum cross-sectional area of the restriction, i.e., the cross-sectional area of nozzle 19 or ring 29. It has been found that when the cross-sectional area of rod 15 is much less than 10% or exceeds 50% of the minimum cross-sectional area of the restriction (i.e., the area of the restriction in the absence of the rod), operation of the device becomes impaired; therefore, these limits should not be exceeded.

For most efficient operation of the device of FIG. 1 or the device of FIG. 7, it is preferable to follow several rules of design. The first rule is that the cross-sectional area of the annulus between frustum 18 (or disc 28) and the surface of passage 10 at least 10% larger, and preferably 20% larger, than the minimum cross-sectional area of the restriction, i.e., the cross-sectional area of nozzle 19 (or ring 29). The second rule is that the annular space between the surface of passage 10 and frustum 18 (or disc 28) be as small as possible consistent with the first rule; the ratio of this space to the base diameter of frustum 18 should never exceed 30%, or, in other words, the ratio of the base diameter of frustum 18 to the diameter of the passage 10 should be at least 0.625. The third rule is that the circumference of frustum 18 (or disc 28) be as large as possible consistent with the first and second rules.

Figure 2:
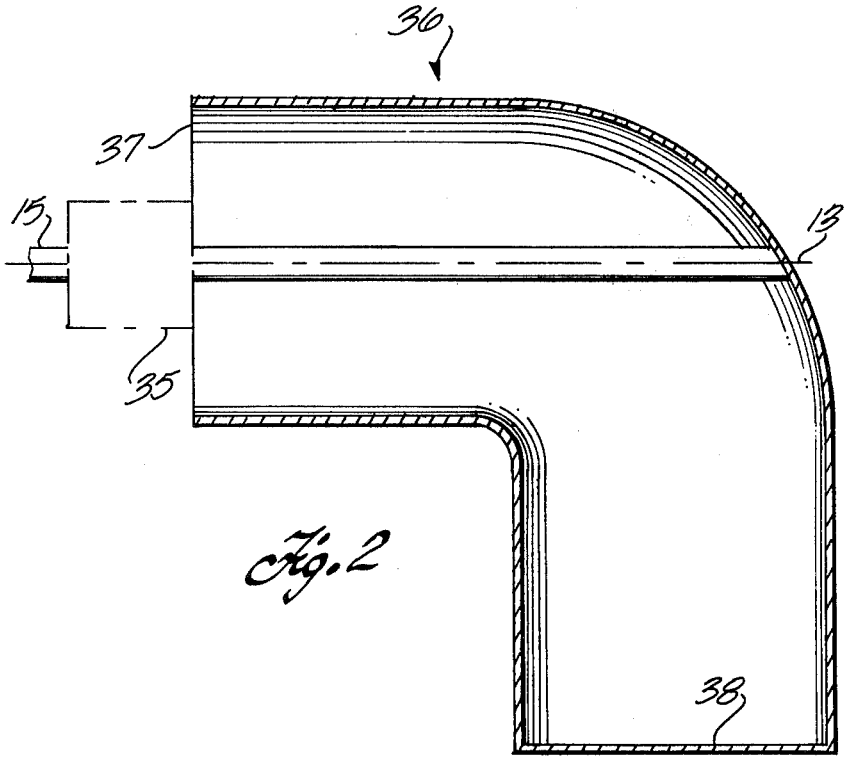
FIG. 2 is a schematic diagram of a variation of the resonator of FIG. 1.

FIG. 2 discloses another embodiment of a resonator for the vortex generating device with external bluff body of FIG. 1. The bluff body is represented at 35 by phantom lines to indicate that different types of bluff bodies for interrupting the fluid flow at the outlet of the passage could be employed, including the embodiments in my referenced application entitled VORTEX GENERATING DEVICE WITH EXERNAL FLOW INTERRUPTING BODY. A resonator 36 shown in a side partially cut away view is elbow-shaped and has a circular cross section. An end 37 of the elbow is open, and an end 38 of the elbow is closed. End 37 faces toward the outlet of the passage and bluff body 35, and end 38 faces at right angles to the outlet of the passage. The end of rod 15 is secured to the wall of resonator 36 opposite open end 37. The cross-sectional diameter of resonator 36 is about one-half the length of resonator 36 from end 37 to the wall thereof to which rod 15 is secured; the cross-sectional diameter of resonator 36 is one-half its length from end 37 to the opposite wall of resonator 36, i.e., the wall to which rod 15 is secured, and one-half the depth of resonator 36, i.e., the distance from end 38 to the opposite wall; end 37 of resonator 36 is spaced from bluff body 35 a distance approximately equal to the width of bluff body 35, e.g., its diameter; and the width of resonator 36, i.e., its cross-sectional diameter is a multiple, i.e., three times, the width of the bluff body.

It has been observed the intensity of the sound waves and also, it is believed, their frequency, is proportional to the gas flow rate, so the device can function for measurement purposes.

To date, the parts of the device have been machined from metal such as steel and, in the case of the resonator, off the shelf copper fittings. However, it is believed that the invention will function to the same extent with molded plastic parts.

The described embodiments of the invention are only considered to be preferred and illustrative of the inventive concept; the scope of the invention is not to be restricted to such embodiments. Various and numerous other arrangements may be devised by one skilled in the art without departing from the spirit and scope of this invention. For example, although a resonator have a circular cross-section as described is preferable, the cross-section of the resonator could also have different shapes such as oblong, square, or rectangular.

What is claimed is:

1. A vortex generating device comprising:

a flow passage having a fluid inlet and a fluid outlet;

a source of gas under pressure larger than the ambient pressure into which the outlet opens connected to the inlet to cause gas to pass through the flow passage;

means for generating in the gas a plurality of tornado-like vortices arranged in a ring about the flow axis, the vortices rotating about the flow axis;

a resonator disposed at the outlet external to the passage to intercept fluid flowing vortically through the passage; and an external bluff body lying between the outlet and the resonator.

2. The device of claim 1, in which the bluff body has a flat surface facing the outlet.

3. The device of claim 1, in which the bluff body comprises first and second frustums arranged apex-to-apex, the first frustum having a base facing toward the outlet and the second frustum having a base facing away from the outlet.

4. The device of claim 3, in which the spacing between the bases of the frustums is approximately equal to the diameter of the frustums.

5. The device of claim 4, in which the thickness of the frustums is less than one-half their diameter.

6. The device of claim 1, in which the bluff body comprises first and second frustums arranged apex-to-apex, the first frustum having a base facing toward the outlet and the second frustum having a base facing away from the outlet, and a third frustum arranged base-to-base with the second frustum.

7. The device of claim 1, in which the bluff body comprises first, second, third, and fourth frustums, the first and second frustums being arranged apex-to-apex, the third and fourth frustums being arranged apex-to-apex, and the second and third frustums being arranged base-to-base.

8. The device of claim 1, in which the bluff body comprises first and second flat circular discs arranged in spaced side-by-side relationship.

9. The device of claim 8, in which the spacing between the discs is approximately equal to the diameter or one-half the diameter of the discs.

10. The device of claim 9, in which the thickness of the discs is less than one-half their diameter.

11. The device of claim 1, in which the bluff body comprises a sphere.

12. The device of claim 1, in which the bluff body comprises a frustum and a sphere, the base of the frustum facing toward the outlet and the apex of the frustum abutting the sphere.

13. The device of claim 1, additionally comprising a rod extending along the full length of the flow passage to an end external to the passage, the bluff body being supported by the end of the rod.

14. The vortex generating device of claim 1, in which the vortex forming means comprising:

a restriction in the flow passage; and an internal buff body disposed in the flow passage upstream of the restriction, the bluff body having a flat surface facing upstream to interrupt fluid flow.

15. The device of claim 14, in which the internal bluff body is a frustum having a base facing upstream and an apex facing downstream.

16. The device of claim 15, in which the inlet is positioned such that the base and a portion only of the frustum are exposed to the inlet.

17. The device of claim 16, in which the flow passage has a given cross-sectional area and the restriction comprises a cylindrical section having a cross-sectional area smaller than the given cross-sectional area, and a diverging section joining the cylindrical section to the outlet.

18. The device of claim 17, additionally comprising a rod aligned with the flow passage, the frustum and the resonator being mounted on the rod.

19. The device of claim 18, in which the rod is hollow and has one or more holes near the restriction, the device additionally comprising a source of liquid to be atomized connected to the rod to feed the liquid to the restriction.

20. The device of claim 14, in which the flow passage, the internal bluff body, the restriction, and the outlet are aligned with a common flow axis, and the inlet is aligned with an axis transverse to the common flow axis.

21. The device of claim 20, in which the internal bluff body comprises a frustum having a base facing upstream and an apex facing downstream.

22. The device of claim 20, in which the internal bluff body comprises a circular disc.

23. The device of claim 14, in which the internal bluff body comprises a circular disc.

24. The device of claim 23, in which the circular disc has a cylindrical edge.

25. The device of claim 23, in which the flow passage has a given cross-sectional area and the restriction comprises a thin flat ring having a circular opening with a cross-sectional area smaller than the given cross-sectional area.

26. The device of claim 25, additionally comprising a rod aligned with the common flow axis in the flow passage, the disc and the resonator being mounted on the rod.

27. The device of claim 26, in which the rod is hollow and has one or more holes near the restriction, the device additionally comprising a source of liquid to be atomized.

28. The device of claim 25, in which the distance between the disc and the ring is the diameter of the disc or one-half the diameter of the disc.

29. The device of claim 28, in which the thickness of the ring is at least one-half the diameter of the disc.

30. The device of claim 14, additionally comprising a rod extending along the flow passage, the bluff body and the resonator being mounted on the rod.

31. The device of claim 30, in which the rod is hollow and has one or more holes near the restriction, the device additionally comprising a source of liquid to be atomized connected to the rod to feed the liquid to the restriction.

32. The device of claim 30, in which the cross-sectional area of the rod is less than 50% of the minimum cross-sectional area of the restriction.

33. The device of claim 32, in which the cross-sectional area of the rod is about 20% of the minimum cross-sectional area of the restriction.

34. The device of claim 14, in which the flow passage has a given cross-sectional area and the restriction comprises a cylindrical section having a cross-sectional area smaller than the given cross-sectional area, and a diverging section joining the cylindrical section to the outlet.

35. The device of claim 14, in which the flow passage has a given cross-sectional area and the restriction comprises a thin, flat ring having a circular hole with a cross-sectional area smaller than the given cross-sectional area.

36. The device of claim 14, in which the space between the internal bluff body and the surface of the flow passage is less than 30% of the distance across the flat surface of the body.

37. The device of claim 14, in which the cross-sectional area of the space between the surface of the flow passage and the internal bluff body is at least 10% larger than the minimum cross-sectional area of the restriction.

38. The device of claim 37, in which the cross-sectional area of the space betweeen the internal bluff body and the surface of the flow passage is about 20% larger than the minimum cross-sectional area of the restriction.

39. The device of claim 14, additionally comprising a source of gas connected to the fluid inlet, the pressure difference between the source and the fluid outlet being such that gas from the source flowing through the flow passage from inlet to outlet forms vortices as it passes over the internal bluff body.

40. The vortex generating device of claim 1, in which the vortex generating means comprises:

a rod in the flow passage, the rod extending across the inlet so fluid flow through the inlet is interrupted by the rod and the resonator being secured to the end of the rod external to the passage; and an internal bluff body mounted on the rod in the flow passage at or near the inlet.

41. The device of claim 40, in which the internal bluff body comprises a frustum having a base facing upstream and an apex facing downstream.

42. The device of claim 40, in which the internal bluff body comprises a circular disc.

43. The device of claim 42, in which the disc has a cylindrical edge.

44. The device of claim 42, in which the thickness of the disc is less than one-half the diameter of the disc.

45. The device of claim 42, in which the flow passage has a given cross-sectional area and the restriction comprises a thin, flat ring having a circular opening with a cross-sectional area smaller than the given cross-sectional area.

46. The device of claim 40, in which the space between the internal bluff body and the surface of the flow passage is less than 30% of the distance across the internal bluff body transverse to the flow axis.

47. The device of claim 40, in which the device additionally comprises a sphere mounted on the one end of the rod beyond the outlet.

48. The device of claim 40, in which the external bluff body comprises a frustum mounted on the one end of the rod beyond the outlet, the apex of the frustum facing upstream and the base of the frustum facing downstream.

49. The device of claim 40, additionally comprising a restriction in the flow passage downstream of the internal bluff body.

50. The device of claim 49, in which the cross-sectional area of the rod is less than 50% of the minimum cross-sectional area of the restriction.

51. The device of claim 50, in which the cross-sectional area of the rod is about 20% of the minimum cross-sectional area of the restriction.

52. The device of claim 49, in which the cross-sectional area between the internal bluff body and the surface of the flow passage is at least 10% larger than the minimum cross-sectional area of the restriction.

53. The device of claim 52, in which the cross-sectional area between the internal bluff body and the surface of the flow passage is about 20% larger than the minimum cross-sectional area of the restriction.

54. The device of claim 49, in which the rod is hollow and has one or more holes near the restriction, the device additionally comprising a source of liquid to be atomized connected to the rod to feed the liquid to the restriction.

55. The device of claim 1, additionally comprising means for combining the plurality of vortices into a single vortex rotating about the flow axis.

56. The device of claim 55, in which the means for forming a plurality of vortices comprises an internal bluff body aligned with the flow axis at or near the inlet.

57. The device of claim 56, in which the means for combining the plurality of vortices comprises a restriction formed in the flow passage between the internal bluff body and the outlet.

58. The device of claim 57, in which the inlet is aligned with an axis transverse to the flow axis.

59. The device of claim 1, in which the fluid flows vortically through the flow passage about a flow axis, and the resonator is columnar, having a longitudinal axis aligned with the flow axis, an open end facing toward the outlet, and a closed end facing away from the outlet.

60. The device of claim 59, in which the resonator has a length parallel to its longitudinal axis and a width perpendicular to its longitudinal axis that are approximately multiples of a common divider.

61. The device of claim 60, in which the external bluff body has a flat circular surface with a given diameter facing the outlet, and the length and width of the resonator are equal to a multiple of the given diameter.

62. The device of claim 59, in which the resonator has a length parallel to its longitudinal axis and a width perpendicular to its longitudinal axis that are approximately equal.

63. The device of claim 62, in which the resonator is cylindrical and its longitudinal axis is the cylindrical axis.

64. The device of claim 1, in which the fluid flows vortically through the flow passage about a flow axis, and the resonator is cylindrical, having a cylindrical axis aligned with the flow axis, an open end facing toward the outlet, and a closed end facing away from the outlet.

65. The device of claim 64, in which the bluff body has an end facing toward the outlet and an end facing away from the outlet, the end facing away from the outlet lying in the same plane as the open end of the resonator.

66. The device of claim 1, in which the fluid flows vortically through the flow passage about a flow axis, and the resonator is elbow-shaped having a central axis aligned at one end with the flow axis, a circular cross section, an open end facing toward the outlet, a closed end facing at right angles to the outlet, and a wall opposite to the open end joining a wall opposite the closed end.

67. The device of claim 66, in which the length of the resonator from the open end to the opposite wall of the resonator and the length of the resonator from the closed end to the opposite wall of the resonator are multiples of the diameter of the circular cross-section of the resonator.

68. The device of claim 1, in which the bluff body has first and second portions between which an annular channel is formed.

69. The device of claim 68, additionally comprising a source of liquid to be atomized and means for supplying liquid from the source to a point along the flow passage for atomization.

70. A sonic transducer comprising:

a flow passage having a fluid inlet and a fluid outlet;

a bluff body disposed at the outlet external to the passage to interrupt fluid flowing through the passage, the bluff body having a surface with a given diameter facing the outlet; and a resonator disposed at the outlet external to the passage to intercept flowing fluid interrupted by the bluff body, the bluff body lying between the outlet and the resonator, the length and width of the resonator being approximately equal to a multiple of the given diameter.

71. The transducer of claim 70, in which the bluff body comprises a frustum having a base facing the outlet.

72. The transducer of claim 70, in which the bluff body comprises first and second frustums arranged apex-to-apex, the first frustum having a base facing toward the outlet and the second frustum having a base facing away from the outlet.

73. The device of claim 70, in which the bluff body comprises first and second frustums arranged apex-to-apex, the first frustum having a base facing toward the outlet and the second frustum having a base facing away from the outlet, and a third frustum arranged base-to-base with the second frustum.

74. The device of claim 73, comprising a fourth frustum arranged apex-to-apex with the second frustum, the base of the fourth frustum facing away from the outlet.

75. The transducer of claim 70, in which the bluff body comprises a sphere.

76. The device of claim 70, in which the bluff body comprises a frustum and a sphere, the base of the frustum facing toward the outlet, and the apex of the frustum abutting the sphere.

77. The device of claim 70, in which the bluff body comprises first and second flat circular discs arranged in side-by-side relationship.

78. The device of claim 70, in which the fluid flows vortically through the flow passage about a flow axis, the resonator is columnar, having a longitudinal axis aligned with the flow axis, an open end facing toward the outlet, and a closed end facing away from the outlet, and the bluff body has an end facing toward the outlet and an end facing away from the outlet, the end facing away from the outlet lying in the same plane as the open end of the resonator.

79. The device of claim 70, in which the fluid flows through the flow passage along a flow axis, and the resonator is columnar, having a longitudinal axis aligned with the flow axis, an open end facing toward the outlet, and a closed end facing away from the outlet.

80. The device of claim 75, in which the resonator has a length parallel to its longitudinal axis and a width perpendicular to its longitudinal axis that are approximately multiples of a common divider.

81. The device of claim 79, in which the resonator has a length parallel to its longitudinal axis and a width perpendicuar to its longitudinal axis that are approximately equal.

82. The device of claim 81, in which the resonator is cylindrical and its longitudinal axis is the cylinder axis.

83. The device of claim 70, in which the fluid flows through the flow passage about a flow axis, and the resonator is cylindrical, having a cylindrical axis aligned with the flow axis, an open end facing toward the outlet, and a closed end facing away from the outlet.

84. The device of claim 70, in which the fluid flows through the flow passage along a flow axis, and the resonator is elbow-shaped having a central axis aligned at one end with the flow axis, a circular cross-section, an open end facing toward the outlet, and a closed end facing at right angles to the outlet, and a wall opposite to the open end joining a wall opposite the closed end.

85. The device of claim 84, in which the length of the resonator from the open end to the opposite wall of the resonator and the length of the resonator from the closed end to the opposite wall of the resonator are multiples of the diameter of the circular cross-section of the resonator.

86. The transducer of claim 70, in which the surface of the bluff body facing the outlet is flat and circular.

87. A vortex generating device comprising:

a flow passage having a fluid inlet and a fluid outlet;

means for forming a vortex in fluid flowing through the passage from inlet to outlet about a flow axis; and a resonator disposed at the outlet external to the passage to intercept fluid flowing vortically through the passage, the resonator being elbow-shaped and having a central axis aligned with one end of the flow axis, a circular cross section, an open end facing toward the outlet, a closed end facing at right angles to the outlet, and a wall opposite to the open end joining a wall opposite the closed end.

88. A sonic transducer comprising:

a flow passage having a fluid inlet and a fluid outlet through which fluid flows vortically about a flow axis;

a bluff body disposed at the outlet external to the passage to interrupt fluid flowing through the passage, the bluff body having a first end facing toward the outlet and a second end facing away from the outlet; and a resonator disposed at the outlet external to the passage to intercept flowing fluid interrupted by the bluff body, the resonator being columnar, having a longitudinal axis aligned with the flow axis, an open end facing toward the outlet in the same plane as the second end of the bluff body, and a closed end facing away from the outlet, the bluff body lying between the outlet and the resonator.

89. A sonic transducer comprising:

a flow passage through which fluid flows about a flow axis between a fluid inlet and a fluid outlet;

a bluff body disposed at the outlet external to the passage to interrupt fluid flowing through the passage; and a resonator disposed at the outlet external to the passage to intercept flowing fluid interrupted by the bluff body, the resonator being elbow-shaped and having a central axis aligned at one end with the flow axis, a circular cross section, an open end facing toward the outlet and a closed end facing at right angles to the outlet, and a wall opposite to the open end joining a wall opposite the closed end, the bluff body lying between the outlet and the resonator.

90. A sonic transducer comprising:

a flow passage having a fluid inlet and a fluid outlet, the flow passage including means for generating a vortex in fluid flowing through the passage;

a bluff body disposed at the outlet external to the passage to interrupt fluid flowing through the passage, the bluff body having two portions between which an annular channel is formed; and a resonator disposed at the outlet external to the passage to intercept flowing fluid interrupted by the bluff body, the two portions lying in a row between the outlet and the resonator.

* * * * *